United States Patent [19]

Gruner et al.

[11] 4,118,018

[45] Oct. 3, 1978

[54] COVER DEVICE FOR CASTING VESSELS, LADLES OR OTHER METALLURGICAL TREATMENT CONTAINERS

[75] Inventors: Hans Grüner; Klaus Terjung, both of Duisburg; Wolfgang Sachse, Düsseldorf; Heinrich-Wilhelm Romerswinkel, Mülheim-Saarn, all of Fed. Rep. of Germany

[73] Assignee: Mannesmann Aktiengesellschaft, Düsseldorf, Fed. Rep. of Germany

[21] Appl. No.: 734,130

[22] Filed: Oct. 20, 1976

[30] Foreign Application Priority Data

Oct. 29, 1975 [DE] Fed. Rep. of Germany ..... 2548827
Nov. 4, 1975 [DE] Fed. Rep. of Germany ..... 2549825

[51] Int. Cl.[2] ..... F27D 3/00

[52] U.S. Cl. ..... 266/275; 220/318; 220/326

[58] Field of Search ..... 432/156–158; 75/49; 164/256; 266/208, 211, 242, 287, 275–278; 220/318, 323, 326

[56] References Cited

U.S. PATENT DOCUMENTS

| | | | |
|---|---|---|---|
| 945,927 | 1/1910 | Forster | 220/318 |
| 1,312,626 | 8/1919 | Grannis | 220/318 |
| 1,488,026 | 3/1924 | Reilly | 266/275 |
| 1,861,946 | 6/1932 | Wilhelmi | 266/275 |
| 2,054,857 | 9/1936 | Gorsline | 220/326 |
| 3,292,916 | 12/1966 | Finkl | 266/211 |
| 3,485,408 | 12/1969 | Beruesch | 220/326 |
| 3,764,124 | 10/1973 | LeMoyne | 266/208 |

*Primary Examiner*—Gerald A. Dost
*Attorney, Agent, or Firm*—Smyth, Pavitt, Siegemund, Jones & Martella

[57] ABSTRACT

A cover device suitable for casting vessels or the like is constructed to have an annular edge portion connected to the vessel by spring means. The cover has also a central portion corresponding to opening of the edge portion and a locking means is provided for locking the central portion with said edge portion.

5 Claims, 4 Drawing Figures

1
6
20
5
4
8
20
20
10
15
8
9
9
20
14

COVER DEVICE FOR CASTING VESSELS, LADLES OR OTHER METALLURGICAL TREATMENT CONTAINERS

BACKGROUND OF THE INVENTION

This invention relates to a cover device for casting pans, ladles, metallurgical treatment containers, vessels, or the like.

It is known to construct such covers or lids in a single piece configuration which may be placed upon the casting vessel, etc., and is subsequently locked in any suitable manner. In view of the fact that the covers must have fireproof lining they are very heavy and, therefore, they are hard to handle while being placed on the vessel or removed therefrom. Furthermore, damage to the masonry lining, particularly in the curved edge portion may readily occur.

Locking of such covers is difficult during large scale operations in manufacture, because on the one hand it is necessary to use a heavy cover, while on the other hand the equipment undergoes rough treatment.

SUMMARY OF THE INVENTION

It is an object of the present invention to provide a cover device of casting vessels or the like which cover device is of such construction that it can be readily put on and removed from the vessel.

A further object of the present invention is to improve the locking of the vessel and the life expectancy of the fireproof lining.

Another object of the present invention is to ensure that the expansion of the fireproof lining is taken care of to minimize fractures and cracks therein.

These and other objects are achieved in accordance with the present invention by constructing the cover to have an annular edge portion which is connected to the casting vessel by spring means. The cover device further includes a central portion corresponding to the opening of the edge portion as well as means for locking the central portion to the edge portion. The locking means is, preferably, composed of stop and guiding cover elements which are fixedly disposed on the edge portion. There is further provided a bridle swingably attached to the central portion, the latter having lateral extensions which are engageable with the guiding cover elements.

It is also feasible to subdivide the annular edge portion into segments. Further it is possible to lock the central portion directly to the vessel, ladle, etc.

In accordance with another modification of the invention it is feasible to connect the cover which is not subdivided, to a vessel by spring means, the cover, however, having a sector-shape or straight cutout. The respective cutouts may be closed and locked with a corresponding fitting piece.

The cover arrangement in accordance with the present invention has a number of advantages over known covers. The edge portion of the cover remains upon the vessel, ladle, etc. Prior art covers consisting of a single piece required packing and sealing between the cover and the vessel prior to each treatment; this procedure is made unnecessary by the plural part cover as per the present invention. Furthermore, the fireproof masonry lining in the curved portions of the cover is no longer damaged when the cover is installed or removed. A further protection for the fireproof lining is due to the abutment action of the fastening elements between the annular edge portion and the vessel. This in turn takes up the changes in dimension of the fireproof lining whereby cracks and seams in the masonry are avoided. Also, erosion at the transition between the pan and the cover is prevented. The opening for the circular central portion of the cover is sufficiently large to be able to fill the vessel. Metallurgical treatments of the melt may be carried out through the opening in the central portion or through the casting spout, or the treatment may be carried out in any known manner. Putting on and removal of the central portion of the cover upon the edge portion is easier and more secure than for a cover consisting of a single piece. Furthermore, a special packing for the interior space of the vessel, ladle, container, etc. is no longer necessary. Container and cover may be tilted together.

By means of the cover arrangement of the invention the heat as supplied is stored in an optimal manner so that cooling is essentially minimized by the solution of the problem in accordance with the invention. A closed treatment space is created when the vessel is closed and this treatment space is separated from the ambient atmosphere.

DESCRIPTION OF THE DRAWINGS

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

Referring now to the figures in some detail, there is illustrated the edge portion 1 of the cover arrangement which is secured to the pan, ladle, vessel, etc. 2, for example, by means of screws. The screws are buffered or biased by spring elements 11. A pair of upstanding elements 5 extend from edge portion 1. They have respectively arc-shaped stop cams 4 forming respectively two stop portions which are solidly secured with the edge portion therewith.

Figure 1:
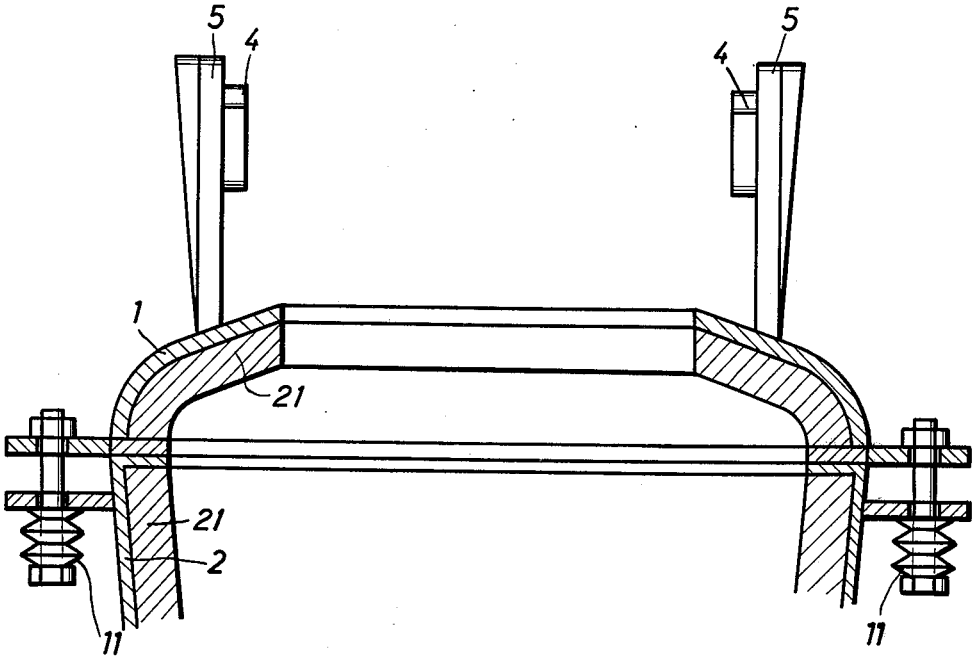
FIG. 1 is a side elevational view partly in section of the upper part of a casting pan with its edge portion.
Figure 2:
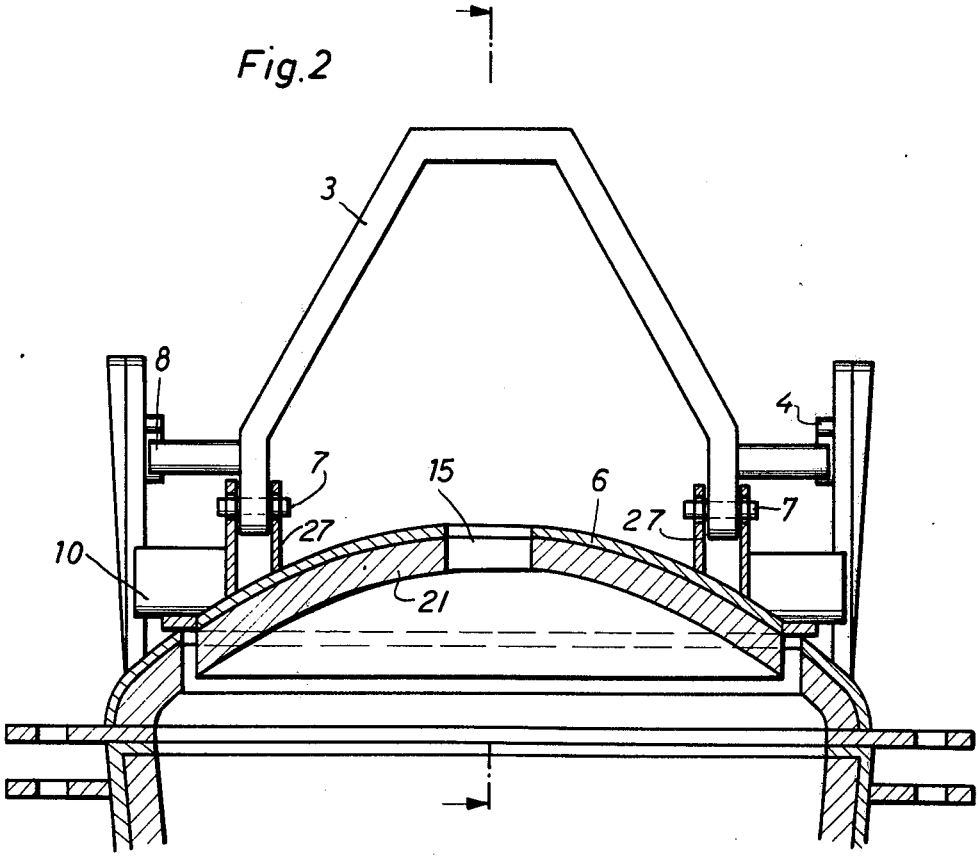
FIG. 2 is a view is similar to that of FIG. 1, but illustrating the circular middle portion with its bridle arranged to be capable of rotational motion.
Figure 3:
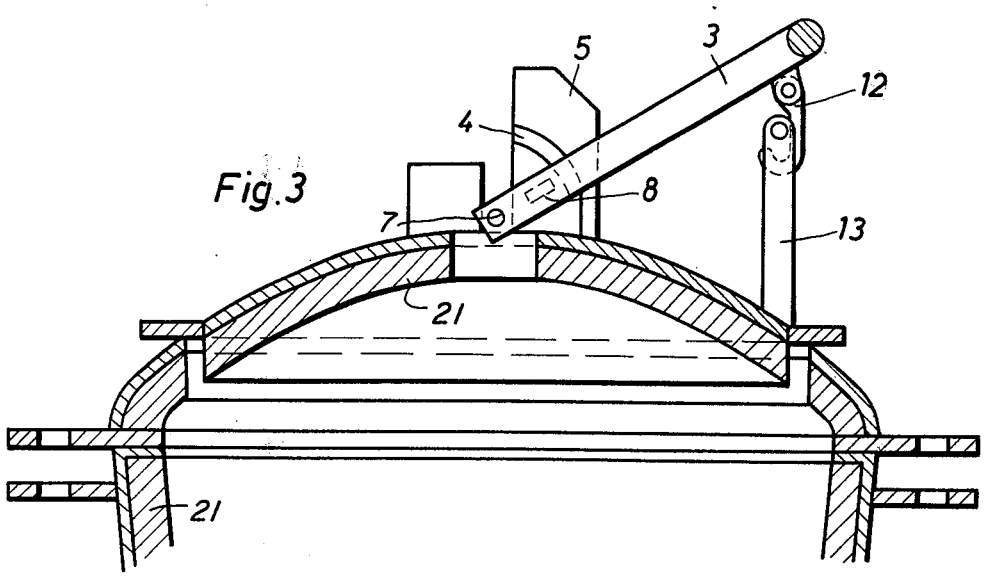
FIG. 3 is a view similar to that of FIG. 2 but showing the bridle in the locked state.

The cover has a circular central portion 6 which is inserted in the edge portion 1 as shown in FIGS. 2 and 3. The central portion, the edge portion and the vessel itself all are provided with fire proof lining 21. A bridle 3 is pivotable connected with the center portion 6 by bolts 7 so that it can be rotated. The bolts are received in bearing stands 27. The bridle 3 has lateral extensions or arms 8 which can be moved underneath the arc-shaped cams 4 of the cover extensions 5, and thereby lock the central portion 6. Upon swinging bridle-3 up, arms 8 clear the cams so that the central portion 6 can be removed. Both of the two elements or extensions 5 are provided with guidance slots or keyways 9 into which extend corresponding guidance latches 10 of the central portion 6 and which ensure a precise insertion of the central portion. The bridle 3 is provided with a hook 12. In order to retain the central portion 6 in its locked states, when the vessel 2 is tilted, the hook 12 hooks into an ear 13 secured to the central portion 6.

Figure 4:
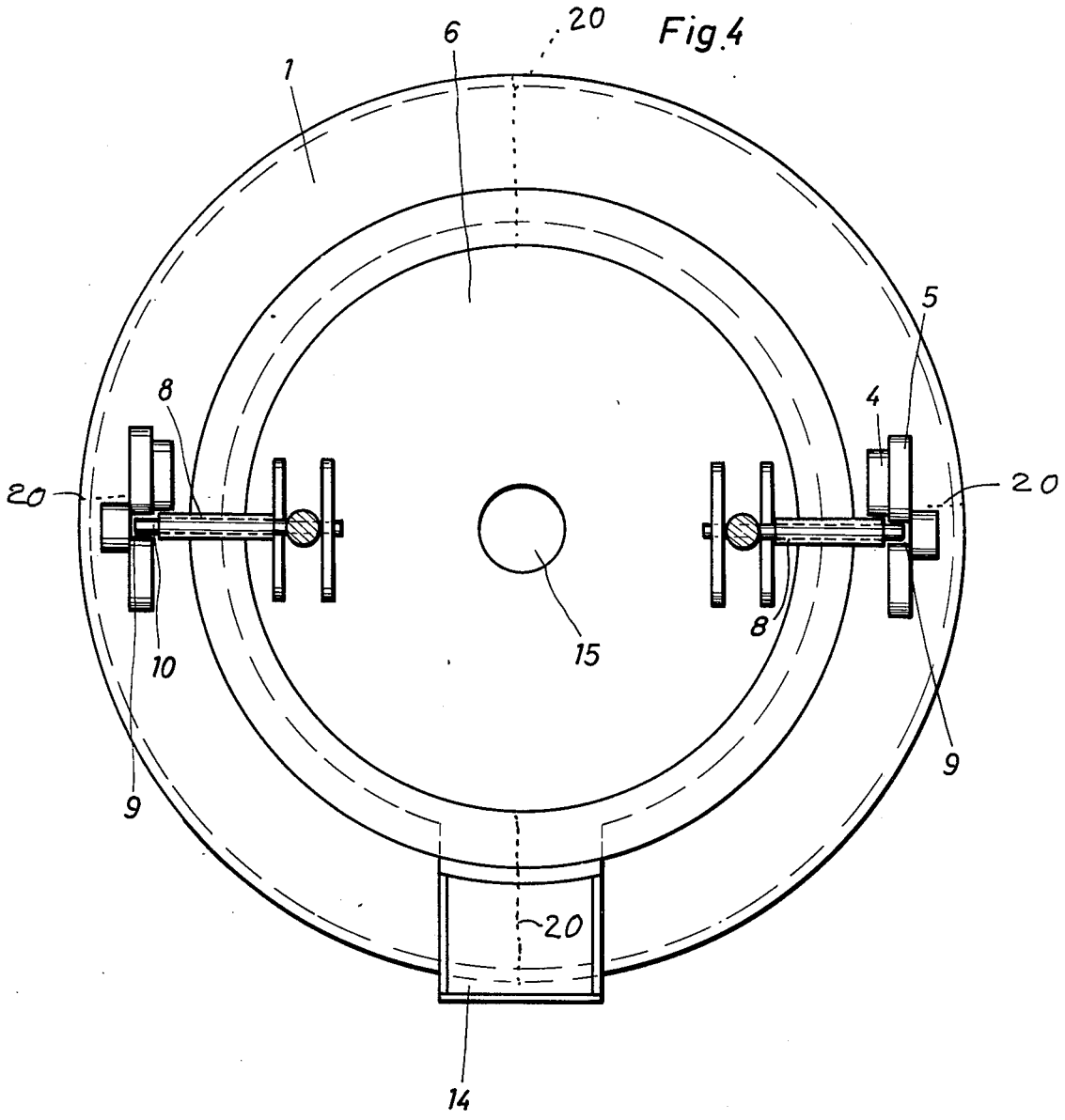
FIG. 4 is a plan view corresponding to that of FIG. 2 showing the cover before it is locked.

The plan view of FIG. 4 illustrates the arrangement of the cover extensions 5 with the guidance elements 9 and 10 for the central portion 6. The edge portion 1 is provided with a casting spout or outlet 14 in a manner known per se. The central portion 6 is provided with one or more openings 15 for the metallurgical treatment of the melt, for example, for the desulfurization. The edge portion 1 may be subdivided into segments as indicated by the dotted lines 20.

The invention is not limited to the embodiments described above but all changes and modifications thereof not constituting departures from the spirit and scope of the invention are intended to be included.

We claim:

1. Cover device for a casting ladle or a metallurgical vessel comprising:

an annular inwardly curving edge portion extending partially over a top opening of the ladle or vessel;

spring biased bolt means for resiliently bolting said edge portion to said ladle or vessel;

a central portion corresponding to the opening of said edge portion and being positioned thereon, said central portion and said edge portions each having fire proof lining;

stop elements rigidly secured to said edge portion; and a bridle tiltably mounted to said central portion, said bridle having lateral extensions, said lateral extensions being capable of engagement with said stop elements for locking the central portion to the edge portion and for releasing the central portion upon disengagement from the stop elements.

2. Cover device as claimed in claim 1 wherein said edge portion is subdivided into segments.

3. A cover device as in claim 1, said elements including vertical key-ways, said central portion being provided with laterally extending latches received by said key-ways.

4. Cover device for for a casting ladle or a metallurgical vessel comprising:

an annular inwardly curving edge portion extending partially over a top opening of the ladle or vessel;

spring biased bolt means for resiliently bolting said edge portion to said ladle or vessel;

a central portion corresponding to the opening of said edge portion and being positioned thereon, said central portion and said edge portions each having fire proof lining;

a bridle; means for pivotally mounting said bridle on the central portion;

a pair of arms extending laterally from the bridle;

a pair of upright elements on the edge portion each having an arc-shaped cam, the elements being positioned so that the arms can engage the cams; and means for fastening the bridle in a tilted position in which the arms engage the cams.

5. A cover device as in claim 4, said upright elements having vertical guide slots, said central portions being provided with extensions received by the guide slots for particularly positioning the central portion in relation to the edge portion.

* * * * *

UNITED STATES PATENT AND TRADEMARK OFFICE

CERTIFICATE OF CORRECTION

PATENT NO. : 4,118,018

DATED : October 3, 1978

INVENTOR(S) : HANS GRUNER; et al

It is certified that error appears in the above-identified patent and that said Letters Patent are hereby corrected as shown below:

[75] HANS GRUNER; KLAUS TERJUNG, both of Duisburg; WOLFGANG SACHSE, Düsseldorf; HEINRICH-WILHELM ROMMERSWINKEL, Mülheim-Saarn; all of the Fed. Rep. of Germany Signed and Sealed this

*Twentieth* Day of *February 1979*

[SEAL]

*Attest:*

RUTH C. MASON
*Attesting Officer*

DONALD W. BANNER
*Commissioner of Patents and Trademarks*